US009404642B2

(12) United States Patent
Chen et al.

(10) Patent No.: US 9,404,642 B2
(45) Date of Patent: Aug. 2, 2016

(54) LIGHTING MODULE, ILLUMINATING DEVICE AND METHOD FOR FABRICATING THE LIGHTING MODULE

(75) Inventors: Xiaomian Chen, Shenzhen (CN); Hoitat Cheng, Hong Kong (CN); Yubao He, Shenzhen (CN); Tengzhi Qin, Shenzhen (CN)

(73) Assignee: OSRAM GMBH, Munich (DE)

( * ) Notice: Subject to any disclaimer, the term of this patent is extended or adjusted under 35 U.S.C. 154(b) by 318 days.

(21) Appl. No.: 13/821,580

(22) PCT Filed: Aug. 17, 2011

(86) PCT No.: PCT/EP2011/064146

§ 371 (c)(1),
(2), (4) Date: Apr. 11, 2013

(87) PCT Pub. No.: WO2012/031865

PCT Pub. Date: Mar. 15, 2012

(65) Prior Publication Data

US 2013/0194803 A1 Aug. 1, 2013

(30) Foreign Application Priority Data

Sep. 10, 2010 (CN) ..... 2010 1 0281136

(51) Int. Cl.

| | |
|---|---|
| ***F21V 21/00*** | (2006.01) |
| ***F21S 2/00*** | (2016.01) |
| ***G09F 13/22*** | (2006.01) |
| *F21Y 101/02* | (2006.01) |

(52) U.S. Cl.

CPC ..... *F21V 21/00* (2013.01); *F21S 2/005* (2013.01); *G09F 13/22* (2013.01); *F21Y 2101/02* (2013.01); *G09F 2013/222* (2013.01); *Y10T 29/49826* (2015.01)

(58) Field of Classification Search

CPC . F21V 21/041; F21V 21/043; F21V 21/0816; F21V 21/00; F21S 2/005

USPC ..... 362/249.11, 249.16, 249.01

See application file for complete search history.

(56) References Cited

U.S. PATENT DOCUMENTS

| | | | | |
|---|---|---|---|---|
| 5,729,925 | A | 3/1998 | Prothero | |
| 5,769,533 | A | 6/1998 | Yamuro et al. | |
| 6,065,854 | A | 5/2000 | West et al. | |
| 6,634,766 | B1 * | 10/2003 | Gordon | 362/249.16 |
| 7,806,561 | B2 * | 10/2010 | Chen | 362/265 |
| 2002/0196623 | A1 | 12/2002 | Yen | |
| 2003/0026095 | A1 | 2/2003 | Tseng | |
| 2003/0206412 | A1 | 11/2003 | Gordon | |
| 2005/0265019 | A1 | 12/2005 | Sommers et al. | |
| 2009/0073693 | A1 | 3/2009 | Nall et al. | |

OTHER PUBLICATIONS

European Office Action based on Application No. 11754325.6 (5 pages) dated Mar. 9, 2016 (Reference Purpose Only).

* cited by examiner

*Primary Examiner* — Karabi Guharay

(74) *Attorney, Agent, or Firm* — Viering, Jentschura & Partner mbB

(57) ABSTRACT

A lighting module for illuminating device may include at least one lighting component; at least one lighting component bracket bearing its corresponding lighting component; and one mounting trail, wherein each lighting component bracket is mounted onto the mounting trail and fixed onto a shell of the illuminating device by the mounting trail.

7 Claims, 2 Drawing Sheets

LIGHTING MODULE, ILLUMINATING DEVICE AND METHOD FOR FABRICATING THE LIGHTING MODULE

RELATED APPLICATIONS

The present application is a national stage entry according to 35 U.S.C. §371 of PCT application No.: PCT/EP2011/064146 filed on Aug. 17, 2011, which claims priority from Chinese application No.: 201010281136.6 filed on Sep. 10, 2010.

TECHNICAL FIELD

Various embodiments relate to a lighting module for illuminating device and method for fabricating the same. In addition, various embodiments also relate to an illuminating device which has the lighting module of the above type.

BACKGROUND

The direct backlight illuminating device has been more and more widely used. Generally, the direct backlight illuminating device uses the LED module which can be designed as chain, plate or puzzle module. However, it is difficult to install the chain module in the light box of a big size because the lighting modules of the chain module should be connected together to form the chain module and to be installed in the light box, which will certainly prolong the installing time and increase the difficulty in installation. The plate module inevitably has the defect of having a high structure weight. And as to the type of puzzle module in the prior art, it also has the defect of having a high structure weight. Moreover, the modules of the above types can hardly meet the requirement of double-side light box, because the LED lighting components in the modules of the above types merely can be arranged on one side of the module. In order to meet the requirement of double-side lighting, at least two groups of modules should be simultaneously arranged to emit light to both sides, respectively, which will necessarily increase the weight of the whole system. A plurality of arcuate rods assembled to form a lamp fence is disclosed in an earlier patent application US application US2003/0026095 A1. However, the lamp fence is used for decoration but not for an illuminating device. Moreover, the assembled fence shape is not suitable for an illuminating device due to the uneven distribution of light.

SUMMARY

Various embodiments provide a lighting module for an illuminating device. The lighting module has a fishbone structure with a relatively light structure weight and can meet the requirement of double-side illumination without notably changing the structure weight; and the thickness of the whole lighting module is quite small.

A lighting module has: at least one lighting component; at least one lighting component bracket bearing respective corresponding lighting component; and one mounting rail, wherein, each lighting component bracket is connected to the mounting rail and fixed onto the shell of the illuminating device by the mounting rail. The lighting component bracket and the mounting rail are designed into a linear shape, such that the lighting component brackets and the mounting rail are installed into a fishbone structure. The structure of such type has relatively a light weight and is easier for installation. The lighting module according to various embodiments has a unique mounting rail, and all the lighting component brackets are mounted on the mounting rail, thereby, a fishbone structure is obtained. In this structure, all the material portions unrelated to the electrical connection and part-bearing are completely removed, which therefore greatly reduces the structure weight of the whole module.

In a preferred solution of the present invention, the mounting rail has a plurality of accommodating portions, and each lighting component bracket is mounted into its corresponding accommodating portion, such that each lighting component bracket can be stably accommodated into its corresponding accommodating portion.

In a preferred solution of the present invention, the mounting rail is fixed onto the shell of the illuminating device by end-caps provided at its both ends. The whole lighting module can be fixed onto the shell in such a simple manner, thereby, the mounting complexity is reduced.

In one specially preferred solution, each lighting component bracket is mounted into its corresponding accommodating portion by interference fit with the fastener such as push screw. Since the lighting component bracket is fixed into corresponding accommodating portion by the fastener, the lighting component bracket can be simply mounted and demounted according to the practical requirements, thereby to provide great application flexibility.

According to one solution of the present invention, the accommodating portions are provided on one same side of the mounting rail along the extending direction of the mounting rail. In such situation, the lighting component brackets are fixed into the corresponding accommodating portions facing the same side, and the lighting components on the lighting component bracket face the same direction, so as to obtain the single-side lighting module.

According to a preferred solution of the present invention, the accommodating portions are provided on both sides of the mounting rail along the extending direction of the mounting rail. In such situation, the lighting component brackets are correspondingly fixed into the accommodating portions facing both sides, and the lighting components on the lighting component brackets face two opposite directions, so as to obtain the double-side lighting module. Moreover, this structure reduces the thickness of the whole lighting module to a great extent.

Preferably according to the present invention, the accommodating portions are notches provided in the mounting rail, and the notches provided on both sides of the mounting rail are in a staggered arrangement. The accommodating portions according to the present invention are sunken into the mounting rail, so that a portion between the lighting components is buried into the accommodating portion after the lighting component bracket is mounted into the accommodating portion, thereby the thickness of the whole lighting module is reduced. The thickness of the whole module in the double-side lighting module is further reduced.

According to one solution of the present invention, pluralities of lighting component brackets are electrically connected with each other in series by wires. Since the wires have a relatively light weight, it further reduces the weight of the whole lighting module.

Various embodiments provide an illuminating device, especially by a direct backlight illuminating device. The device has the lighting module of at least one of the above types. The whole illuminating device of such type has relatively a light structure weight, and the structure weight will not be notably changed when double-side illumination is realized; moreover, its whole thickness is quite small.

Various embodiments provide a method for fabricating the lighting module. The method may include:

a) providing at least one lighting component;

b) fixing the at least one lighting component onto its corresponding lighting component bracket, wherein the lighting component bracket is designed into a linear shape;

c) mounting the at least one lighting component bracket onto one mounting rail, wherein the mounting rail is designed into a linear shape; and d) installing the lighting component bracket and the mounting rail into a fishbone structure.

In step c) of the method according to the present invention, the lighting component brackets are fixed on one same side of the mounting rail. In such situation, the lighting components on the lighting component brackets face the same direction so as to obtain the single-side lighting module.

Preferably, in step c) of the method according to the present invention, the lighting component brackets are fixed on both sides of the mounting rail. In such situation, the lighting components on the lighting component brackets face two opposite directions so as to obtain the double-side lighting module. Preferably, the method according to the present invention further includes step e): the plurality of lighting component brackets are electrically connected with each other in series by wires, which realizes the electrical connection between the lighting component brackets in a simple manner and the structure weight is further reduced with the electrical connection by wires.

It should be understood that the general descriptions above and the detailed descriptions below are illustrative, and aim at providing further understanding to the claimed invention.

BRIEF DESCRIPTION OF THE DRAWINGS

The drawings constitute a portion of the Description for further understanding of the present invention. These drawings illustrate the embodiments of the present invention and explain the principle of the present invention together with the Description. In the drawings, the same element is represented by the same reference sign, wherein.

DETAILED DESCRIPTION

The following detailed description refers to the accompanying drawings that show, by way of illustration, specific details and embodiments in which the invention may be practiced.

Figure 1:
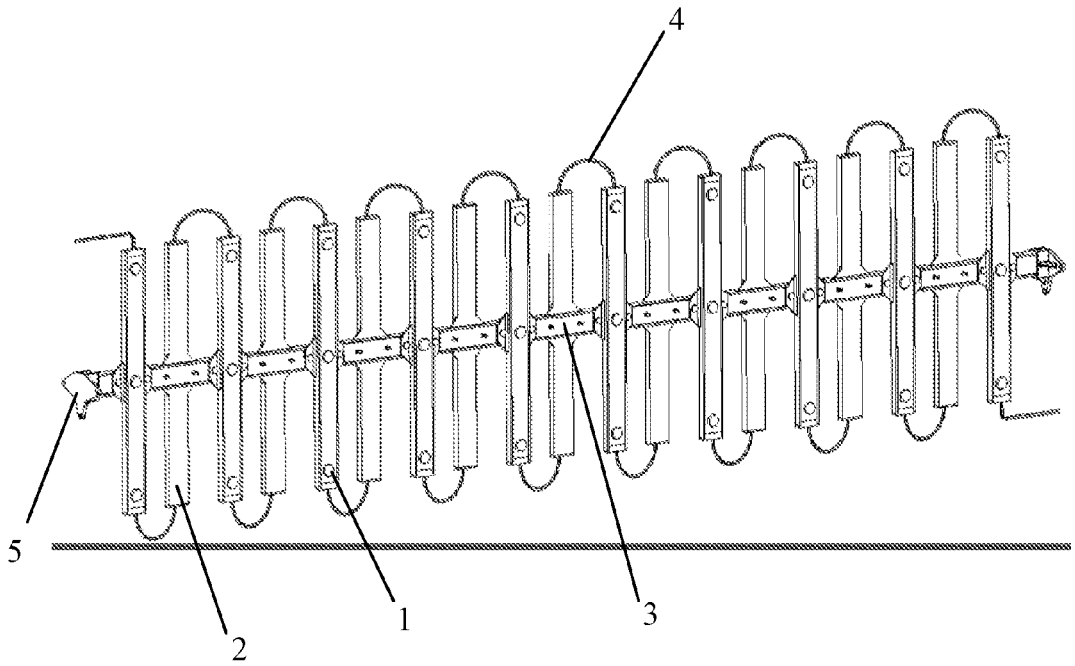
FIG. 1 is a scheme of the lighting module according to the present invention.

FIG. 1 shows the scheme of the lighting module according to the present invention. It can be seen from the figure that the lighting module has a fishbone structure. A plurality of lighting component brackets 2 are sequentially fixed on both sides of the mounting rail 3 with respective lighting component brackets 2 being electrically connected with each other in series by wires 4. In addition, each lighting component bracket 2 is provided with three lighting components 1 (in the present embodiment three LED components are provided thereon), of course, it also can be provided with the lighting component 1 of some other numbers, such as 4, 5 or 6. The lighting components 1 in each lighting component bracket 2 are electrically connected with each other in series. It further can be seen from FIG. 1 that the mounting rail 3 has the end-cap 5 at both ends, respectively, and is fixed onto the shell (not shown) of the illuminating device by the end-caps 5.

Figure 2:
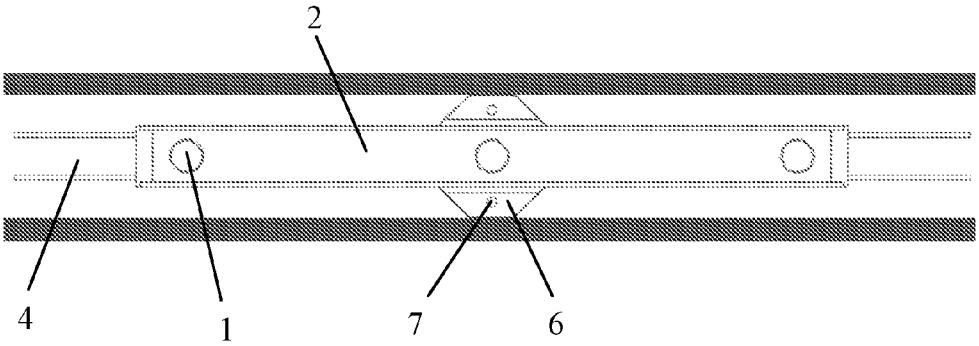
FIG. 2 is a scheme of the lighting component bracket for the lighting module according to the present invention.

FIG. 2 shows the scheme of the lighting component bracket 2 for the lighting module according to the present invention. Three lighting components 1 on the lighting component bracket 2 are electrically connected with each other in series by the wires 4.

Moreover, it can be seen from FIG. 2 that a mounting lug 6, provided with throughholes 7, is provided to each of both sides of the middle part of the lighting component bracket 2. The mounting lug 6 is accommodated in the accommodating portion 8 (shown in FIG. 3 in detail) of the mounting rail 3.

Figure 3:
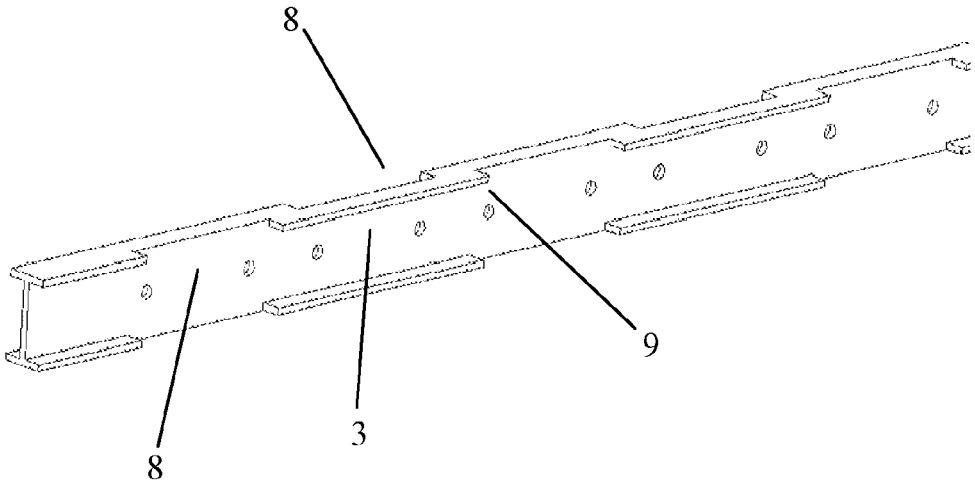
FIG. 3 is a scheme of the mounting rail for the lighting module according to the present invention.

FIG. 3 shows the scheme of the mounting rail 3. The mounting rail 3 has on both sides a plurality of accommodating portions 8 for accommodating the mounting lugs 6 of the lighting component brackets 2 shown in FIG. 2. Moreover, the accommodating portions 8 are provided with throughholes 9 corresponding to the throughholes 7 of the mounting lug 6. From the figure it can be seen that the accommodating portions 8 in the form of notch are arranged on both sides of the mounting rail 3.

Figure 4:
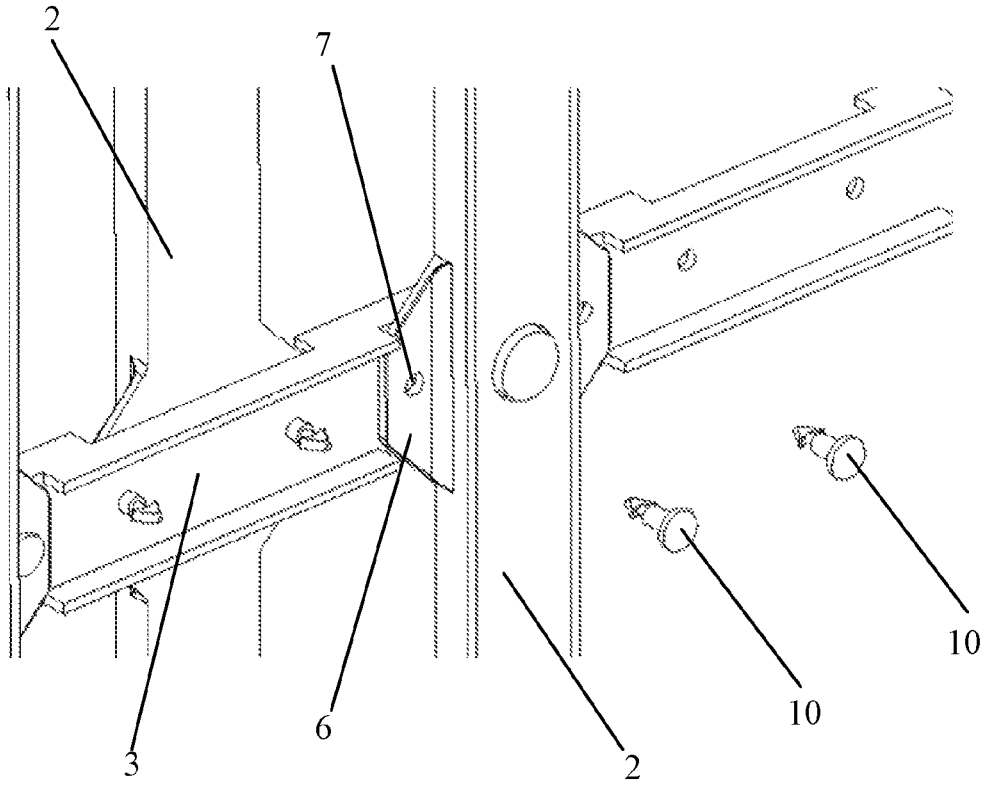
FIG. 4 is a scheme of the lighting component brackets being fixed onto the mounting rail according to the present invention.

FIG. 4 shows the scheme of the lighting component brackets 2 being fixed onto the mounting rail 3. It can be seen from the figure that the mounting lug 6 of the lighting component bracket 2 should be inserted into the accommodating portion 8 of the mounting rail 3. Moreover, the fastener 10 such as push screw is inserted into the throughhole 7 and the throughhole 9 subsequently to aligning the throughhole 7 of the mounting lug 6 with the throughhole 9 of the accommodating portion 8 so as to fix the lighting component bracket 2 onto the mounting rail 3. On the left of FIG. 4 shows the lighting component bracket 2 already fixed onto the mounting rail 3, in which the mounting direction of the lighting component bracket 2 is just opposite to that of the lighting component bracket 2 on the right of the figure, so as to realize double-side illumination.

The above is merely preferred embodiments of the present invention but not limiting the present invention. For the person skilled in the art, the present invention may have various alterations and changes. Any alterations, equivalent substitutions, improvements, within the spirit and principle of the present invention, should be covered in the protection scope of the present invention.

LIST OF REFERENCE SIGNS

1 lighting component (LED component)
2 lighting component bracket
3 mounting rail
4 wire
5 end-cap
6 mounting lug
7 throughhole
8 accommodating portion
9 throughhole
10 fastener (push screw)

The invention claimed is:

1. A lighting module for illuminating device, the lighting module comprising:

at least one lighting component;

a plurality of first and second lighting component brackets bearing corresponding lighting component; and one mounting rail formed in a linear shape with end-caps provided at each of two ends of the mounting rail, wherein the first and the second lighting component brackets are formed in a linear shape with a first and a second ends;

wherein the mounting rail is longer than the first and the second lighting component brackets;

wherein the first and the second lighting component brackets are mounted onto the mounting rail and perpendicular to the mounting rail having a cross shape extending to the left and right of the mounting rail;

wherein the first lighting component brackets and the second lighting component brackets are alternately provided on the front and the back sides of the mounting rail;

wherein the first end of the first lighting component brackets are electrically connected with the first end of the second lighting component brackets by wires and the second end of the first lighting component brackets are electrically connected with the second end of the second lighting component brackets by wires; and wherein the mounting rail is fixed onto a shell of the illuminating device by the end-caps of the mounting rail.

2. The lighting module according to claim 1, wherein the mounting rail has a plurality of accommodating portions, and the first and the second lighting component bracket are mounted into its corresponding accommodating portion.

3. The lighting module according to claim 2, wherein the first and the second lighting component bracket are mounted into its corresponding accommodating portion by interference fit with a fastener.

4. The lighting module according to claim 2, wherein the plurality of accommodating portions are provided on both sides of the mounting rail, respectively, along an extending direction of the mounting rail.

5. The lighting module according to claim 4, wherein the accommodating portions are notches provided in the mounting rail, wherein the notches provided on both sides of the mounting rail are in a staggered arrangement.

6. An illuminating device, comprising:

at least one lighting module, comprising:

at least one lighting component;

a plurality of first and second lighting component brackets bearing corresponding lighting component; and one mounting rail formed in a linear shape with end-caps provided at each of two ends of the mounting rail, wherein the first and the second lighting component brackets are formed in a linear shape with a first and a second ends;

wherein the mounting rail is longer than the first and the second lighting component brackets;

wherein the first and the second lighting component bracket are mounted onto the mounting rail and perpendicular to the mounting rail having a cross shape extending to the left and right of the mounting rail;

wherein the first lighting component brackets and the second lighting component brackets are alternately provided on the front and the back sides of the mounting rail;

wherein the first end of the first lighting component brackets are electrically connected with the first end of the second lighting component brackets by wires and the second end of the first lighting component brackets are electrically connected with the second end of the second lighting component brackets by wires; and wherein the mounting rail is fixed onto a shell of the illuminating device by the end-caps of the mounting rail.

7. A method for fabricating a illuminating device, the method comprising:

a) providing at least one lighting component;

b) fixing the at least one lighting component onto corresponding a first and a second lighting component bracket, wherein the first and the second lighting component bracket are formed in a linear shape with a first and a second ends;

c) mounting the at least one lighting component bracket onto one mounting rail, wherein the mounting rail is formed in a linear shape with end-caps provided at each of two ends of the mounting rail, and wherein the mounting rail is longer than the first and the second lighting component brackets;

d) installing the first and the second lighting component bracket perpendicular to the mounting rail having a cross shape extending to the left and right of the mounting rail, wherein the first lighting component brackets and the second lighting component brackets are alternately provided on the front and the back sides of the mounting rail;

e) electrically connecting the first end of the first lighting component brackets and the first end of the second lighting component brackets, and the second end of the first lighting component brackets and the second end of the second lighting component brackets in series by wires; and f) fixing the mounting rail onto a shell of the illuminating device by the end caps of the mounting rail.

* * * * *